United States Patent [19]

Platone et al.

[11] Patent Number: 4,969,929

[45] Date of Patent: Nov. 13, 1990

[54] FLUIDIZING AND DISPERSING ADDITIVES FOR COAL-WATER DISPERSIONS

[75] Inventors: Edoardo Platone, Asti; Aldo Prevedello; Riccardo Rausa, both Milan, all of Italy

[73] Assignee: Eniricerche, S.p.A., Milan, Italy

[21] Appl. No.: 187,488

[22] Filed: Apr. 28, 1988

[30] Foreign Application Priority Data

May 26, 1987 [IT] Italy ..... 2067 A/87

[51] Int. Cl.[5] ..... C10L 1/32; B01J 13/00

[52] U.S. Cl. ..... 44/280; 252/311; 252/351; 44/70

[58] Field of Search ..... 252/311, 356, DIG 1, 252/351; 44/51, 70; 406/49

[56] References Cited

U.S. PATENT DOCUMENTS

| | | | |
|---|---|---|---|
| 3,325,537 | 6/1967 | Beasley et al. | 252/356 |
| 4,261,701 | 4/1981 | Schulz et al. | 44/51 |
| 4,502,868 | 3/1985 | Yaghmaie et al. | 44/51 |
| 4,578,456 | 3/1986 | Pober | 208/44 X |
| 4,627,855 | 12/1986 | Mathiesen et al. | 44/51 |
| 4,762,529 | 8/1988 | Schulz | 44/51 |

*Primary Examiner*—Richard D. Lovering
*Assistant Examiner*—Daniel S. Metzmaier
*Attorney, Agent, or Firm*—Hedman, Gibson, Costigan & Hoare

[57] ABSTRACT

A fluidizing and dispersing additive for coal-water mixtures, constituted by an ethoxylated adduct of either natural humic acids, or of humic acids deriving from partial coal oxidation.

4 Claims, No Drawings

FLUIDIZING AND DISPERSING ADDITIVES FOR COAL-WATER DISPERSIONS

The present invention relates to dispersing and fluidizing additives for water-coal mixtures.

More particularly, the present invention relates to dispersing and fluidizing additives obtained by means of the ethoxylation of humic acids.

It is known that coal constitutes an energy source available in large amounts. Therefore, the progressive replacement of petroleum products by coal as the primary energy source is hypothesizable. However, it is well known that replacing petroleum with coal is not easy, because, on one hand, treating a liquid fuel is much simpler and cheaper than treating a solid fuel, and, on the other hand, all presently existing infrastructures and experiences in the field of energy production are substantially concerned with the use of fluid-state fuels.

Therefore, it was proposed to convert coal into a dispersion which could be handled (i.e., transported, stored and burnt) in the fluid form, by producing coal dispersions in liquid vehicles. Among these media, water is the cheapest. However, having available high-concentration coal dispersions on water is necessary, in order not to decrease the heat value of the mixture, and not to excessively increase the transport costs.

The production of water-coal dispersions with high coal concentrations causes considerable problems, above all as regards the stability and the pumpability of coal/water dispersions.

Suspensions having a high enough flowability for pumping, as well as stability for storage are obtained by means of the addition of suitable additives.

U.S. Pat. No. 3,019,059 proposes to add to coal-water mixtures an additive constituted by a product of partial oxidation of coal, generally referred to as "coal acids", in order to decrease the viscosity of, and render pumpable, said mixture.

By "coal acids", in the above cited patent a set of products are meant, which range from low-molecular weight, water-soluble acids and their alkali-metal or ammonium salts, to humic acids, which have higher molecular weights, and are not soluble in water; and their alkali-metal and ammonium salts, soluble in water.

The additives disclosed in the above-cited U.S. patent can be used in case of water coal mixtures wherein the concentration of solid matter is lower than 50%, and is preferably comprised within the range of from 30 to 40%, as is explicitly stated in said patent, but cannot be used for water-coal dispersions wherein the percentage of the solid matter is higher than 50%, and in particular is comprised within the range of from 55 to 80% of coal, such as those dispersions which are presently used in the industrial practice.

Furthermore, humic acids, and, in general, the "coal acids", as well as their alkali-metal or ammonium salts, are sensitive to the presence of cations, or to changes in pH value, which may lead to the precipitation of the salts of said cations, or of the free acid, in case of salts of humic acids in an acidic medium.

In fact, it is known that in the preparation of aqueous suspensions of coal, the possible release occurs of polyvalent cations, and/or of acidic materials contained in same coal.

The present Applicant has surprisingly found now that as additives for water-coal suspensions containing more than 50% by weight of solids, ethoxylated adducts of humic acids, as defined hereinbelow, can be used.

By "humic acids", in the specification of the instant invention both the humic acids of natural origin, which can be used by extraction from peats, lignites and still other carbonaceous products, and those acid products which are obtained by the partial oxidation of coal, as well as fractions obtained from said oxidation product by extraction with aqueous alkaline solutions, and subsequent acidification, are meant.

The above-mentioned partial oxidation of coal may be carried out by means of any one of the methods known from the prior art, such as, e.g., oxidation with nitric acid, with permanganate in an alkaline solution, with oxygen, or air. Some of these methods are mentioned in above cited U.S. Pat. No. 3,019,059.

The ethoxylated adducts of humic acids according to the invention contain from 50 to 300 parts by weight, and preferably from 70 to 150 parts by weight, of ethoxy chain per each part by weight of humic acid.

The additives according to the invention can be added to water-coal dispersions in an amount comprised within the range of from 0.1 to 1.5%, and preferably of from 0.3 to 0.7%.

EXAMPLES

Three substrates were ethoxylated, which derived from partial coal oxidation:

(1) Humic acids (Examples 1–6) obtained by means of the partial oxidation of coal and extracted from same coal with aqueous sodium hydroxide.

(2) Oxidated coal (Examples 7–9), i.e., the raw product from coal oxidation reaction.

(3) Commercial humic acids (Example 10).

The humic acids used in Examples 1–6 have the following analytical characteristics:

Moisture : 2.0%

Ashes : none

Elemental analysis of the product, as obtained:

Carbon : 61.66%

Hydrogen : 3.20%

Nitrogen : 1.16%

Sulphur 0.50%

Total acidity (carboxy acids +phenolic OH groups) =9.3 meq/g.

The oxidated coal used in Examples 7–9 has the following analytical characteristics:

Moisture : 2.50%

Ashes : 11.0%

Elemental analysis of the product, as obtained:

Carbon : 58.12%

Hydrogen : 3.24%

Nitrogen : 1.04%

Sulphur 0.49%

Total acidity (carboxy acids +phenolic OH groups)=7.7 meq/g.

The commercial humic acids used in Example 10 were purchased from FLUKA AG, CH-9470 Buchs (Switzerland), and their ash content is of 10–15%.

EXAMPLE 1

To an autoclave of 1 litre of capacity, equipped with a magnetic-drive stirrer and provided with ethylene oxide and nitrogen inlets, thermometer pocket, pressure gauge and safety valve, 11.20 g of humic acids and 1.50 g of finely ground KOH are charged. The autoclave is sealed, is tested for tightness, is purged with nitrogen, the stirring is started up and the autoclave is heated up to approximately 140–150° C.

Then, within a time of approximately 210 minutes, 25 g of ethylene oxide is fed. During this step, the temperature increases up to 166° C. At the end of ethylene oxide addition, the reaction is let continue for a further hour at approximately 160° C.

The autoclave is then cooled down to 90–100° C., and the reaction product is discharged: 220 g.

EXAMPLE 2

By using the same autoclave as described in Example 1, 9.80 g of humic acids and 2.55 g of potassium hydroxide are charged to it.

Within a time of approximately 210 minutes, 392 g of ethylene oxide is fed at 142–169° C.

The reaction is allowed to proceed for a further hour at these temperatures, then the autoclave is cooled and the reaction product is discharged: 385 g.

EXAMPLE 3

By using the same autoclave as described in Example 1, 4.92 g of humic acids and 2.75 g of potassium hydroxide are charged to it.

Within a time of approximately 130 minutes, 428.8 g of ethylene oxide is fed at 138–172° C.

The reaction is allowed to proceed for a further hour at these temperatures, then the autoclave is cooled and the reaction product is discharged: 420 g.

EXAMPLE 4

By using the same autoclave as described in Example 1, 2.64 g of humic acids and 2.53 g of potassium hydroxide are charged to it.

Within a time of approximately 125 minutes, 396.7 g of ethylene oxide is fed at 143–177° C.

The reaction is allowed to proceed for a further hour at these temperatures, then the autoclave is cooled and the reaction product is discharged: 389 g.

EXAMPLE 5

By using the same autoclave as described in Example 1, 2.01 g of humic acids and 2.56 g of potassium hydroxide are charged to it.

Within a time of approximately 110 minutes, 402 g of ethylene oxide is fed at 140–172° C.

The reaction is allowed to proceed for a further hour at these temperatures, then the autoclave is cooled and the reaction product is discharged: 390 g.

EXAMPLE 6

By using the same autoclave as described in Example 1, 2.747 g of humic acids and 0.488 g of potassium hydroxide are charged to it.

Within a time of approximately 260 minutes, 412 g of ethylene oxide is fed at 136–179° C.

The reaction is allowed to proceed for a further hour at these temperatures, then the autoclave is cooled and the reaction product is discharged: 391 g.

EXAMPLE 7

By using the same autoclave as described in Example 1, 4.67 g of oxidated coal and 2.40 g of potassium hydroxide are charged to it.

Within a time of approximately 2 hours, 373.4 g of ethylene oxide is fed at 152–176° C.

The reaction is allowed to proceed for a further hour at these temperatures, then the autoclave is cooled and the reaction product is discharged: 354 g.

EXAMPLE 8

By using the same autoclave as described in Example 1, 2.88 g of oxidated coal and 2.75 g of potassium hydroxide are charged to it.

Within a time of approximately 2 hours, 432 g of ethylene oxide is fed at 140–176° C.

The reaction is allowed to proceed for a further hour at these temperatures, then the autoclave is cooled and the reaction product is discharged: 424 g.

EXAMPLE 9

By using the same autoclave as described in Example 1, 2.015 g of oxidated coal and 2.557 g of potassium hydroxide are charged to it.

Within a time of approximately 110 minutes, 403 g of ethylene oxide is fed at 140–173° C.

The reaction is allowed to proceed for a further hour at these temperatures, then the autoclave is cooled and the raw reaction product is discharged: 394 g.

EXAMPLE 10

By using the same autoclave as described in Example 1, 4.33 g of commercial humic acids, and 2.77 g of potassium hydroxide are charged to it.

Within a time of approximately 110 minutes, 433 g of ethylene oxide is fed at 139–175° C.

The reaction is allowed to proceed for a further hour at these temperatures, then the autoclave is cooled and the reaction product is discharged: 426 g.

RHEOLOGICAL CHARACTERIZATION

The ethoxylated adducts of humic acids disclosed in Examples 1–10 were characterized as fluidizers by measuring the viscosities of concentrated dispersions of coal in water in the presence of these additives.

For that purpose, measurements were carried out at various speed gradients, by using an RV12 Haake rotational viscometer.

For that purpose, inside a beaker of 200 cc, 35 g of imported coal, dry-ground to a granulometry smaller than 60 mesh is weighed, and known-titre solution of the investigated additive and water are added, to that a slurry is eventually obtained, which has the following composition:

68.5% by weight of coal;
0.5% by weight of additive;
31.0% by weight of water.

The whole mass is stirred with a metal-whip stirrer for one minute at 650 rpm, and for 2 minutes at 1,200 rpm.

The so-obtained suspension is then charged to the viscometer, which is already at the controlled temperature of 20° C., and the values of the shear stress at various speed gradients (max. 150 $sec^{-1}$) are measured.

In the following Table, the apparent viscosities at 30 and $100^{-1}$ sec are reported as mPa.s.

Furthermore, the values of K and n are reported, which are obtained by applying to the experimental data the power equation:

$$\tau = K \cdot \dot{\gamma}^n$$

(wherein: $\tau$ = shear stress, as Pascal; $\dot{\gamma}$ = speed gradient, as $sec^{-1}$)

TABLE 1

| Example | Grams of Ethylene Oxide / Grams of Humic Acids | Potassium Hydroxide / Potassium hydroxide + Humic Acids + Ethylene Oxide 100 | Apparent Viscosity at 30 $s^{-1}$ (m.Pa.s) | Apparent Viscosity at 100 $s^{-1}$ (m.Pa.s) | K | n |
|---|---|---|---|---|---|---|
| 1 | 20 | 0.54 | 590 | 458 | 1.533 | 0.740 |
| 2 | 40 | 0.54 | 545 | 439 | 1.138 | 0.795 |
| 3 | 100 | 0.54 | 445 | 360 | 0.767 | 0.843 |
| 4 | 150 | 0.54 | 525 | 414 | 0.823 | 0.823 |
| 5 | 200 | 0.54 | 357 | 313 | 0.598 | 0.858 |
| 6 | 150 | 0.10 | 482 | 358 | 1.308 | 0.714 |
| 7 | 80 | 0.54 | 333 | 290 | 0.203 | 1.101 |
| 8 | 150 | 0.54 | 408 | 362 | 0.414 | 0.003 |
| 9 | 200 | 0.54 | 341 | 298 | 0.903 | 0.864 |
| 10 | 100 | 0.54 | 430 | 320 | 1.058 | 0.737 |

We claim:

1. A water coal composition comprising: an effective amount of fluidizing and dispersing additive comprising an ethoxylated derivative of humic acids, wherein the humic acids are selected from the group consisting of products of oxidation of coal, and acidic materials obtained by the extraction of the coal oxidation products with aqueous alkaline solution followed by acidification of the coal oxidation products.

2. The water-coal composition according to claim 1 wherein the weight ratio of the ethoxy chain to humic acid is from 50 to 300.

3. The water-coal composition according to claim 2 wherein the weight ration of the ethoxy chain to humic acid is from 70 to 150.

4. The water-coal composition according to anyone of the claims 1, 2 or 3 wherein the composition contains from 0.3% to 0.7% of the additive.

* * * * *